United States Patent [19]

Deak, Jr.

[11] Patent Number: 4,778,187

[45] Date of Patent: Oct. 18, 1988

[54] MODIFIED CHESS GAME METHOD OF PLAY

[76] Inventor: Joseph W. Deak, Jr., 2105 Quail Ridge, Plainsboro, N.J. 08536

[21] Appl. No.: 921,619

[22] Filed: Oct. 22, 1986

[51] Int. Cl.[4] ..... A63F 3/02
[52] U.S. Cl. ..... 273/261
[58] Field of Search ..... 273/261, 260, 262

[56] References Cited

U.S. PATENT DOCUMENTS

D. 241,358 9/1976 Benson, Jr. ..... 273/261 X
4,147,360 4/1979 Bailey ..... 273/261

FOREIGN PATENT DOCUMENTS 214636 5/1941 Switzerland ..... 273/261
1030519 5/1966 United Kingdom ..... 273/261

OTHER PUBLICATIONS

Chess Variations; "Double Chess"; pp. 203–208; by John Gollon; copyright 1968.

*Primary Examiner*—Richard C. Pinkham
*Assistant Examiner*—Benjamin Layno

[57] ABSTRACT

A method for playing a modified chess game, on a modified chess board having a main playing area of eight squares by eight squares with each side extending four rows to form a plus-type design having a total of 128 alternating black and white squares, uses two to four sets of conventional chess pieces, each set being a different color. At least two of the sets are arranged so that all queens occupy the same colored squares. Then all pieces move in the conventional manner. In addition, when a pawn takes an opposing piece and enters into one of the four extended rows, it continues on a straight path toward the furthest row of that extended area.

1 Claim, 2 Drawing Sheets

MODIFIED CHESS GAME METHOD OF PLAY

BACKGROUND OF INVENTION

1. Field of Invention

The invention relates to the game of chess.

2. Description of Prior Art

Chess is centuries old and has been played by two people, each with a set of 16 pieces playing on an eight square by eight square board. This game is an international pastime, and also a sport. It utilizes concentration and determination, but lacks social interaction due to the fact that it limits the number of players. Here lies the need for a simplistic game which uses the same rules and maneuvers as conventional chess, but having more social interactions by allowing more than two players to play the game at one time.

SUMMARY OF INVENTION

The invention relates to a chess game that can be played by two, three, or four players.

The game apparatus includes a modified chess board, and four different colored sets of conventional chess pieces. The said modified board has a main playing area of 8 squares by 8 squares. Each side of the board extends 4 rows to form a plus type design.

A feature of the invention is to combine conventional chess maneuvers with different playing strategies, making the game a challenging multiple player game.

Another feature of the invention is to provide a chess game which can be played by two, three, or four players.

DESCRIPTION OF PREFERRED EMBODIMENT ENTITLED MODIFIED CHESS GAME

Figure 1:
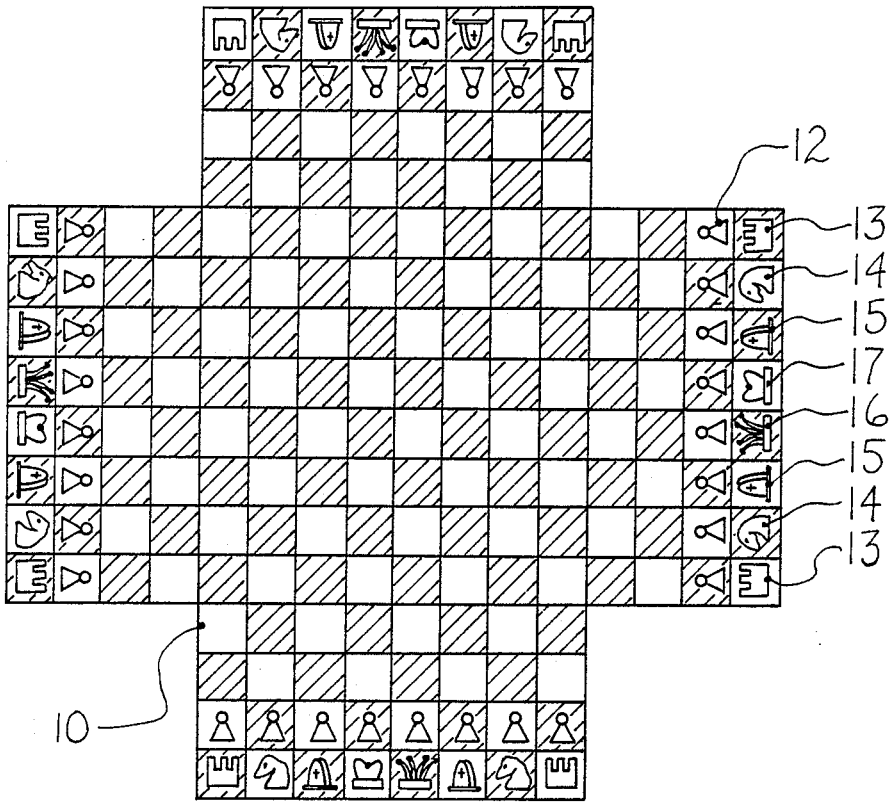
FIG. 1 Is a view of the playing board with designated piece locations.

Let it be known that the terminology, and construction of the parts is for the purpose of description, and not of limitations to be placed on the invention. The general features of the invention can be seen in FIG. 1. It can also be seen that the game is played on a modified board 10. The modified board 10 has a main playing area of eight squares by eight squares. Each side of the modified board 10 extends four rows to form a "plus" type design, having a total of 128 alternating black and white squares.

Each of the four chess sets are positioned on the farthest sides of the modified board 10. A chess set consists of 16 pieces; eight pawns 12, two rooks 13, two knights 14, two bishops 15, one queen 16, and one king 17. In order to differentiate pieces, each set is a different color. The sets being black, white, red, and blue. The arrangement of pieces are that of conventional chess, except for the king 17 and queen 16.

A special king 17 and queen 16 set up must be used when arranging the pieces prior to the start of the game to maintain an equal balance of power during the beginning of the game. In the king 17 and queen 16 set up, the queen 16 is opposite the opponents king 17.

Figure 2:
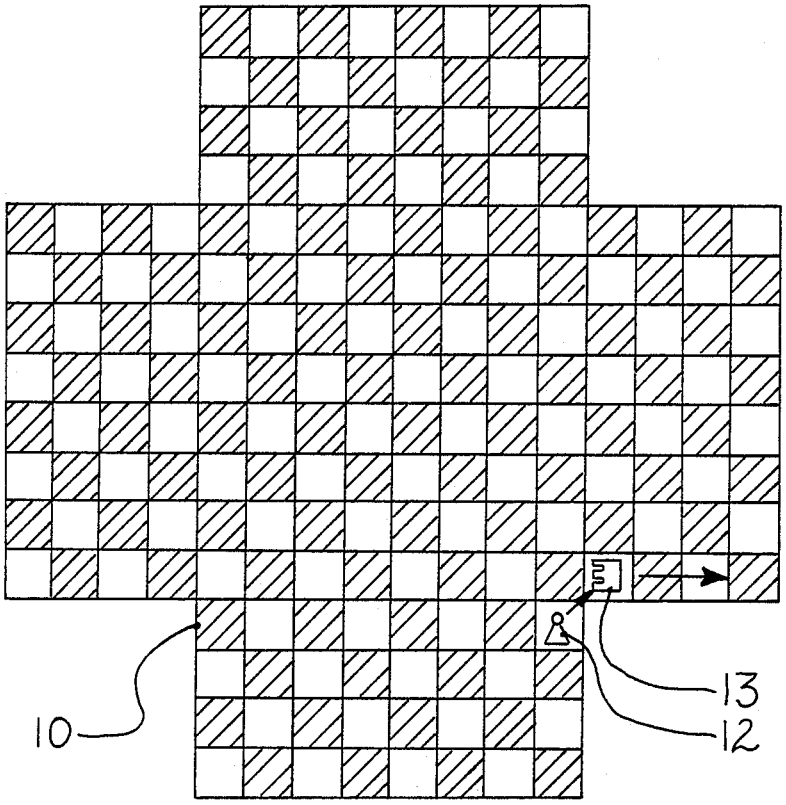
FIG. 2 Is a view showing the pawns movement in a sideward direction.

Referring now to FIG. 2, the pawn 12 movement. The pawn 12 moves in the same manner as in conventional chess. However, if the pawn 12 takes a piece on a diagonal and enters into one of the four rows off the main playing area, then it will proceed on a straight path toward the opponents last row. Once reaching the furthest row, it can be exchanged for any playing piece but the king 17.

I claim as my invention:

1. A method of playing a chess game wherein the game comprises a game board and a plurality of distinguishable sets of playing pieces, said game board comprising a main playing area having four sides and being defined by an eight square matrix of alternately colored playing spaces, said game board further comprising extensions extending from each side of the main playing area, each extension being comprised of a plurality of rows of alternately colored spaces such that the game board as a whole defines a plus-shaped pattern, each set of playing pieces comprising a conventional and standard set of chess playing pieces that include a plurality of pawns, knights, rooks, and bishops as well as a king and queen; said method comprising the steps of: each player placing his playing pieces on the game board so that each player's playing pieces occupy a different extension and so that each player's playing pieces occupy the two rows of spaces on the extension that are located farthest from the main playing area; each player, in turn, moving one of his playing pieces from one space on the board to another according to certain restrictions on the movement capabilities of each piece; any player during his turn and when desired, moving his playing piece to a space occupied by an opponent's piece and subsequently thereto, removing the opponent's pieces as an indication that the opponent's piece has been captured; each player who during a turn moves his pawn playing piece from one space diagonally adjacent space that is located on one of the extensions and that contains an opponent's playing piece, removing from the board the opponent's playing piece and within the same turn, moving his pawn playing piece to the row of spaces in that extension furthest from the main playing area.

* * * * *